US008269680B2

(12) United States Patent
Oki et al.

(10) Patent No.: US 8,269,680 B2
(45) Date of Patent: Sep. 18, 2012

(54) VEHICLE ANTENNA ASSEMBLY

(75) Inventors: Hidehito Oki, Dublin, OH (US); Masashi Noda, Tomioka (JP); Seiji Go, Tomioka (JP)

(73) Assignees: Honda Motor Co., Ltd., Tokyo (JP); Yokowo Co., Ltd., Tokyo (JP)

( * ) Notice: Subject to any disclaimer, the term of this patent is extended or adjusted under 35 U.S.C. 154(b) by 474 days.

(21) Appl. No.: 12/550,705

(22) Filed: Aug. 31, 2009

(65) Prior Publication Data

US 2011/0050519 A1 Mar. 3, 2011

(51) Int. Cl.
*H01Q 1/32* (2006.01)
*H01Q 7/08* (2006.01)

(52) U.S. Cl. ..... 343/711; 343/788; 343/878

(58) Field of Classification Search ..... 343/711, 343/713, 787, 788, 878, 872
See application file for complete search history.

(56) References Cited

U.S. PATENT DOCUMENTS

| | | | | |
|---|---|---|---|---|
| 4,275,400 | A * | 6/1981 | Miyakoshi | 343/788 |
| 4,725,395 | A | 2/1988 | Gasparaitis et al. | |
| 5,305,406 | A * | 4/1994 | Rondeau | 385/81 |
| 5,648,788 | A | 7/1997 | Bumsted | |
| 5,836,072 | A | 11/1998 | Sullivan et al. | |
| 6,219,902 | B1 | 4/2001 | Memmen et al. | |
| 6,338,812 | B1 | 1/2002 | Ogura | |
| 7,724,199 | B2 * | 5/2010 | Someya et al. | 343/788 |
| 2005/0115059 | A1 | 6/2005 | Fuseya et al. | |

FOREIGN PATENT DOCUMENTS

| | | |
|---|---|---|
| JP | 11-225012 | 8/1999 |
| JP | 2002-361675 A | 12/2002 |

* cited by examiner

*Primary Examiner* — Hoang V Nguyen
(74) *Attorney, Agent, or Firm* — Rankin, Hill & Clark LLP

(57) ABSTRACT

A vehicle antenna assembly includes an element coil, a holder, and a retainer. The element coil can have a polygonal configuration in a cross-section taken normal to a coil access. The holder can include rails. The retainer can engage the rails and apply a compressive load on the element coil to fix the element coil with respect to the holder. A method for holding an antenna element is also disclosed.

22 Claims, 4 Drawing Sheets

VEHICLE ANTENNA ASSEMBLY

BACKGROUND

Antenna elements for on-vehicle antennas are typically simple shapes such as cylindrical element coils. A typical cylindrical element coil is held by an element holding structure. A typical element holding structure is simply a molded one-piece plastic structure that is molded around the element coil.

During normal molding processes with cylindrical element coils, any torsion can appear as an expansion or as a contraction of the outer diameter of the coil. For a cylindrical element coil, this torsion can be easily accommodated when molding the element holding structure. However, when the element coil is a shape other than cylindrical, because of variations in coil torsion and dimensions, it can be very difficult to set the element coil in the mold and therefore it is very difficult to use normal molding processes.

SUMMARY

A vehicle antenna assembly that can overcome the aforementioned shortcomings includes an element coil, a holder, and a retainer. The element coil has a polygonal configuration in a cross section taken normal to a coil axis. The holder includes rails. The retainer engages the rails and applies a compressive load on the element coil to fix the element coil with respect to the holder.

An example of an assembly for holding an antenna element that can overcome the aforementioned shortcomings includes a holder and a sliding retainer. The holder includes a support surface and at least two rails extending from the support surface. The at least two rails include a first rail spaced from a second rail to define a gap. The sliding retainer can be received between the first rail and the second rail for retaining an associated antenna element against the holder.

A method for holding an antenna element that can overcome the aforementioned shortcomings is also disclosed. The method includes positioning an element coil on a holder having rails and passing a sliding retainer through the rails and an interior of the element coil. The sliding retainer can fix the element coil to the holder.

DETAILED DESCRIPTION

Figure 1:
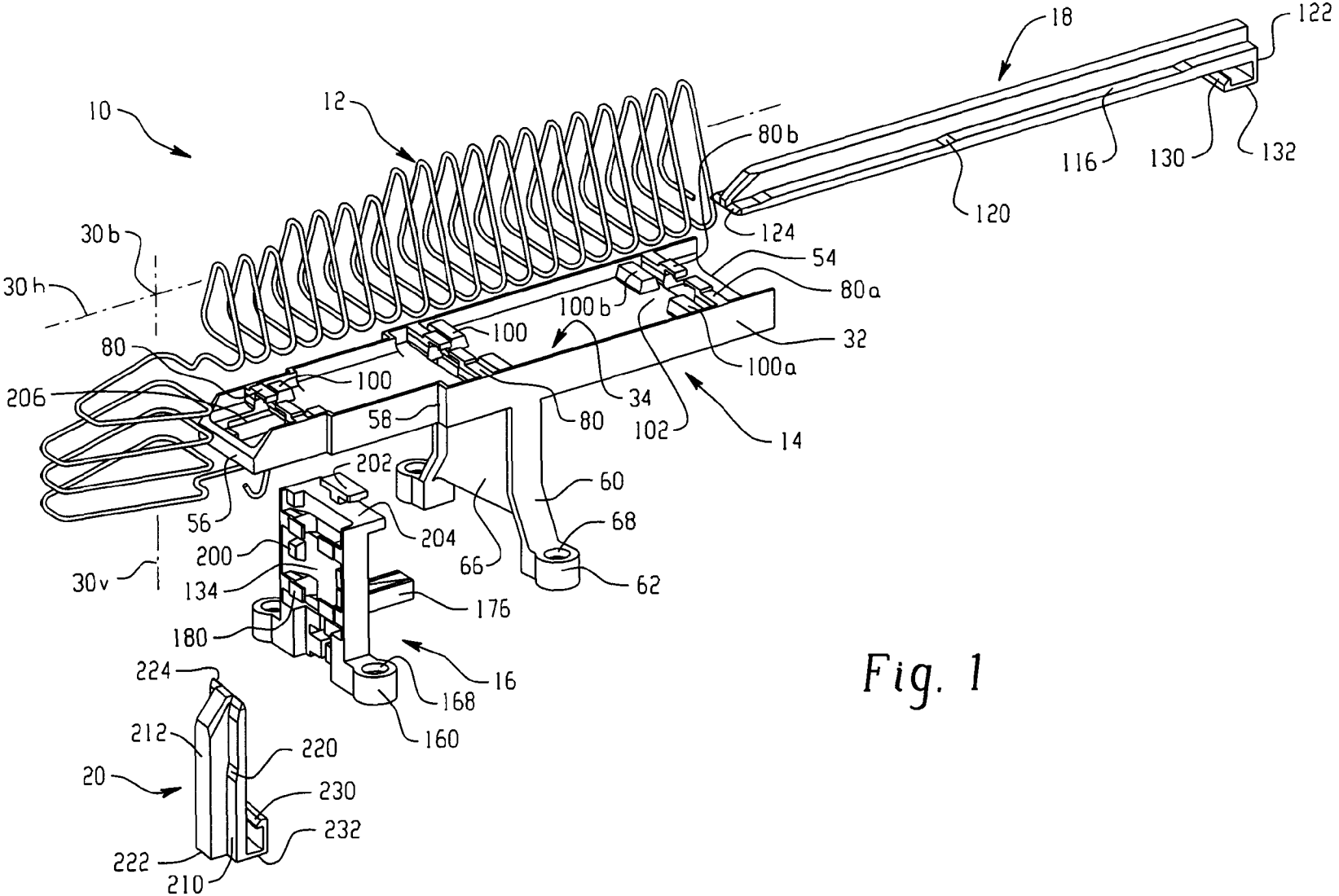
FIG. 1 is an exploded view of a vehicle antenna assembly.

With reference to FIG. 1, a vehicle antenna assembly 10 includes an element coil 12, a holder, which includes a first holder 14 and a second holder 16, and a retainer, which includes a first retainer 18 and a second retainer 20. In the embodiment depicted in FIG. 1, the holder includes the first holder 14 and the second holder 16, and the retainer includes the first retainer 18 and the second retainer 20. However, if desired, a fewer or a greater number of holders and retainers can be provided. Although not required, the holder and the retainer can hold the element coil 12 in place while preventing the element coil from experiencing torsion. Since it is not necessary to completely fill the coil 12 with plastic, which is different from known cylindrical elements, there is no dielectric body completely surrounding the element coil which can realize an improvement in antenna sensitivity.

With continued reference to FIG. 1, the element coil 12 has a polygonal configuration in a cross section taken normal to a coil axis, which in the depicted embodiment is bent at bend 30*b* such that the coil axis includes a generally horizontal section 30*h* and a generally vertical section 30*v*. The element coil 12 has a substantially triangular configuration in a cross section taken normal to the horizontal section 30*h* of the coil axis and a substantially trapezoidal configuration in a cross section taken normal to a vertical section 30*v* of the coil axis. The element coil 12 can take other polygonal configurations. With continued reference to the depicted embodiment, the size of the triangular configuration of the coil element 12 decreases from an end of the element coil 12 furthest from the bend 30*b* moving toward the bend 30*b* in the coil axis 30*h*. Also in the depicted embodiment, the size of the trapezoidal configuration increases moving away from the bend 30*b* in the coil axis 30*v*. The element coil 12 is made from an electrically conductive material, such as a metal wire.

With continued reference to the illustrated embodiment, the first holder 14 includes a platform 32 that defines a support surface 34. The first holder 14 is symmetrical with respect to a plane P (FIG. 3) that is normal to the support surface 34 and intersects the horizontal section 30*h* of the coil axis. As more clearly seen in FIG. 3, the support surface 34 includes a substantially planar section 36 and rounded opposite edges 38, which generally conform with rounded corners 44, respectively, of the element coil 12. With continued reference to FIG. 3, the platform 32 also includes sidewalls 48 that extend upwardly from the support surface 34 and, in the depicted embodiment, are generally parallel to one another. The distance between the sidewalls 48, measured perpendicular to the coil axis 30*h*, is greater adjacent a first end 54 of the platform 32 as compared to a second end 56. With reference back to FIGS. 1 and 2, steps 58 formed in each sidewall 48 extend inwardly toward the coil axis 30*h* resulting in the decreasing distance between the sidewalls. Accordingly, the width of the support surface 34, as measured perpendicular to the coil axis 30*h*, can decrease to accommodate the decrease in the cross sectional triangular configuration of the element coil 12. The steps 58 can also be appropriately located to maintain a desired pitch for the element coil 12, which will be described in more detail below.

The first holder 14 also includes a support 60 that is connected with and supports the platform 32. In the illustrated embodiment, the platform 32 and the support 60 are integrally formed, e.g. a one-piece plastic part, and are made from a dielectric material. The support 60 includes legs 62 (two legs are depicted) that are interconnected by a web 66. A fastener opening 68 is located at the base of each leg 62. The fastener openings 68 each receive a respective fastener 74 (see FIG. 2). The support 60, in the depicted embodiment, is generally perpendicular to the platform 32 and is centrally located between the first end 54 and the second end 56 of the platform.

Figure 4:
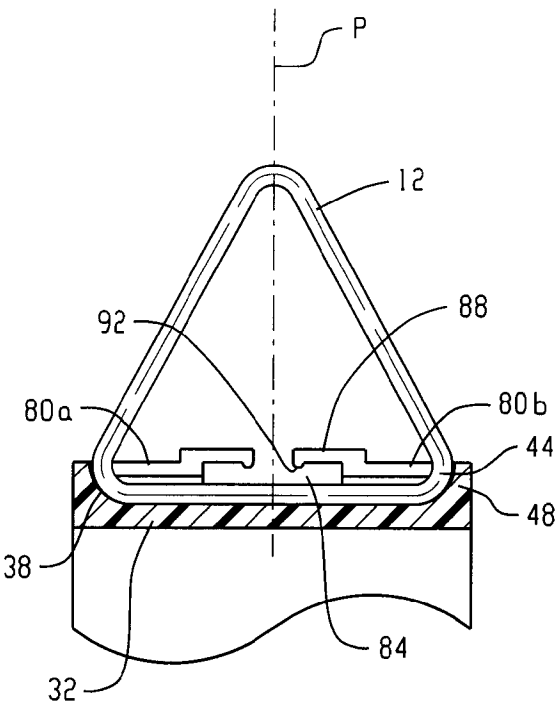
Figure 3:
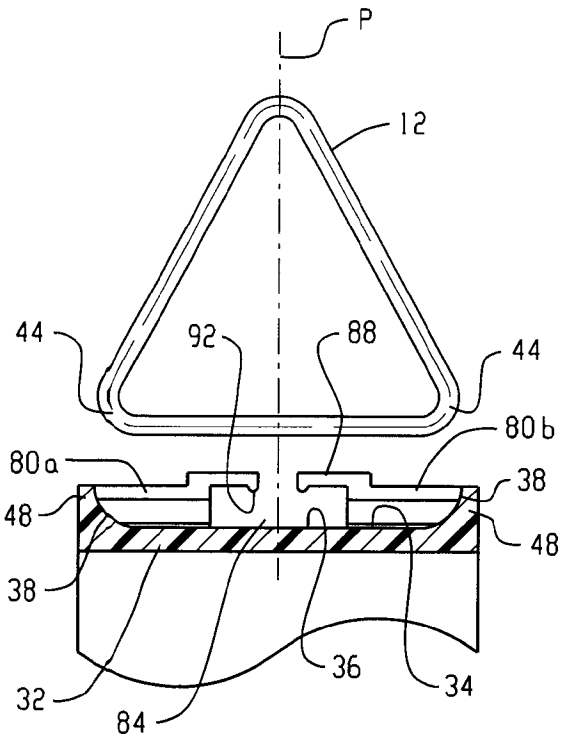

The first holder 14 also includes rails 80, three pairs of which are shown in FIG. 1. Each of the rails 80 are similarly shaped. With reference to FIG. 4, the rails 80 on one side of the plane P of symmetry are mirror images of the rails 80 on the opposite side of the plane of symmetry. With reference to FIG. 3, each pair of rails includes a first rail 80*a* spaced from a second rail 80*b* in a direction generally perpendicular to the horizontal portion 30*h* of the coil axis and normal to the plane P of symmetry to define a gap 84.

Figure 5:
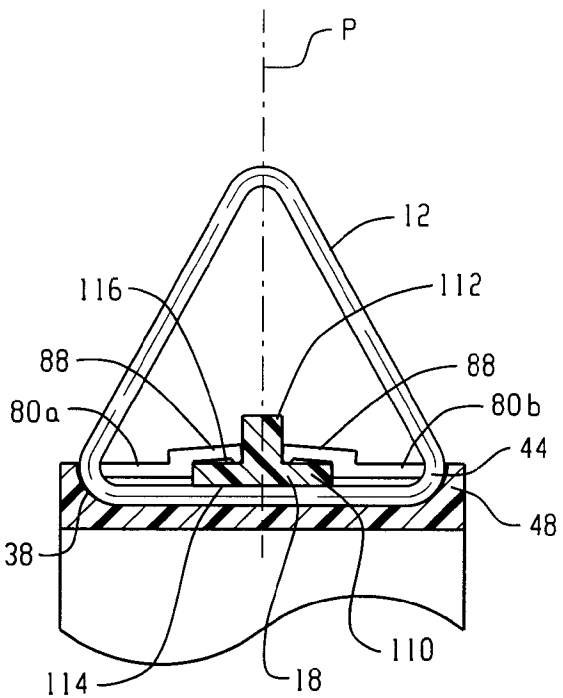
FIGS. 3-5 are schematic cross-sectional views through the antenna assembly of FIG. 2 taken normal to a coil axis of an element coil of the vehicle antenna assembly.

The rails 80 extend upwardly from the support surface 34 and each rail includes a resilient cantilevered section 88 extending over a portion of the gap 84. With reference to FIG. 5, each cantilevered section 88 contacts the first retainer 18 for holding the first retainer in the gap 84. Each resilient cantilevered section 88 applies a compressive force against the antenna element 12 trapping a portion of the antenna element between the resilient cantilevered sections 88 and the support surface 34 of the platform 32. Each cantilevered section 88 includes a downwardly depending protuberance 92. The protuberances 92 are formed at respective distal ends of the cantilevered sections 88. The resilient cantilevered sections 88 are vertically spaced (per the orientation shown in FIGS. 3-5) to accommodate the first retainer 18 and the diameter of the element coil 12, as shown in FIG. 5.

With reference back to FIG. 1, the first holder 14 also includes protrusions 100 extending upwardly from the support surface 34. Each protrusion 100 in the illustrated embodiment is generally block-shaped. Similar to the rails 80, the protrusions 100 are grouped in pairs between the first end 54 and the second end 56 of the platform 32. A respective protrusion 100 is spaced from a respective rail 80 a distance, which is measured parallel to the coil axis 30*h*, about equal to the diameter of the wire making up the element coil 12. For example, the protrusion 100 and the respective rail 80 nearest the first end 54 of the platform 32 and on the same side of the plane P of symmetry are spaced from one another a distance only slightly larger than the diameter of the wire of the element coil 12. Accordingly, the protrusions 100 and the rails 80 cooperate to maintain proper pitch for the element coil 12. As seen in FIG. 1, a pair of protrusions is provided with each pair of rails; however, the respective side of the rails where the protrusions are located can be different for each pair. Each pair of protrusions 100 includes a first protrusion 100*a* spaced from a second protrusion 100*b* in a direction generally perpendicular to the plane P of symmetry to define a gap 102 through which the first retainer 18 can be inserted.

Also, as mentioned above, the steps 58 can be located to help maintain proper pitch. For example, the central rails 80 (with respect to the first end 54 and the second end 56) are spaced from the steps 58 to accommodate the diameter of the wire of the element coil 12. Also, the protrusions 100 nearest the second end 56 can be offset from the step 58 nearest the second end a distance equal to the pitch of the element coil 12 plus the diameter of the wire of the element coil.

The first retainer 18 engages the rails 80 and applies a compressive load on the element coil 12 to fix the element coil with respect to the first holder 14. In the illustrated embodiment, the first retainer 18 slides into engagement with the first holder 14, and thus may also be referred to as a sliding retainer. The first retainer 18 is made from a dielectric material, and in the illustrated embodiment is made from plastic. The first retainer 18 is elongated in a direction parallel with the coil axis 30*h*. Accordingly, the first retainer 18 has a longest dimension parallel with the coil axis 30*h*. To engage the first holder 14, the first retainer 18 slides in a direction parallel with the coil axis 30*h*.

The first retainer 18 is generally upside down T-shaped in a cross section taken normal to the longest dimension of the first retainer. With reference to FIG. 5, the first retainer includes a base 110 and a column 112 extending generally normal to the base. In the illustrated embodiment, the base 110 and the column 112 are integrally formed with one another.

With continued reference to FIG. 5, the base 110 in the illustrated embodiment has a first (lower per the orientation in FIG. 5) surface 114 facing toward the support surface 34 of the platform 32 of the first holder 14 and a stepped second surface 116 facing away the support surface 34. The stepped surface 116, which is more easily visible in FIG. 1, includes ramps 118 that slope downwardly moving from a first end 122 toward a second end 124 of the first retainer 18. The ramps 118 facilitate insertion of the first retainer 18 underneath the resilient cantilevered sections 88 of the rails 80. The thickness of the base 110 decreases at the ramps 118 and the thickness of the base 110 is thickest adjacent the first end 122 and thinnest adjacent the second end 124. This configuration facilitates easy insertion of the first retainer 118 through the rails 80 and passing of the first retainer through the interior of the element coil 12 to fix the element coil to the first holder 14. The thickness of the base 110 is determined by providing a tight fit with the resilient cantilevered sections 88 of the rails 80 at different locations along the first retainer 14 moving from the first end 54 to the second end 56 of the platform 32.

The distance that the protuberances 92 are vertically offset from the support surface 34 of the platform 32 can be slightly less than the thickness of the portion of the base 110 that engages the protuberance 92 when the first retainer 18 is fully inserted and the diameter of the wire for the element coil 12. With reference to FIG. 3, the distance that the protuberances 92 are offset (vertically in FIG. 3) from the support surface 34 is greatest adjacent the first end 54 of the platform 32 and is smallest adjacent the second end 56. Accordingly, the first end 124 of the first sliding retainer 18 can pass easily underneath the cantilevered sections 88 of the rails 80 adjacent the first end 54, but as the first sliding retainer is continued to be pushed toward the second end 56, the cantilevered sections 88 engage the base 110 of the retainer 18 (see FIG. 5) and provide a compressive force on the base 110 thus providing a compressive force on the element coil 12.

With reference back to FIG. 5, the thickness of the column 112 for the first retainer 18, measured perpendicular to the coil axis 30*h* and the plane P of symmetry, is slightly less than the distance measured between the respective distal ends of the resilient cantilevered sections 88 of the rails 80. The column 112 extends from the first end 122 of the first retainer 18 to the second end 124. The column 112 is beveled adjacent the second end 124, which can also facilitate passing the sliding retainer through the rails 80 and the interior of the element coil 12.

With reference back to FIG. 1, the first retainer 18 also includes a barb 130 adjacent the first end 122 for engaging the first holder 14. In the depicted embodiment, the first retainer 18 includes a flange 132 that depends downwardly (per the orientation shown in FIG. 1) from the base 110 at the first end 122. The flange 132 is generally L-shaped and the barb 130 is located adjacent a distal end of the L-shaped flange.

As mentioned above, the holder includes the first holder 14 and the second holder 16. The second holder 16 connects with the first holder 14. The second holder 16 cooperates with the second retainer 20 in much the same manner that the first holder 14 cooperates with the first holder 18. The first holder 14 retains the element coil 12 having the coil axis (horizontal coil axis 30*h*) aligned in a first orientation and the second holder 16 retains the element coil 12 having the coil axis (vertical coil axis 30*v*) aligned in a second orientation, which is angled (perpendicular in the depicted embodiment) with respect to the first orientation.

The second holder 16 includes a support surface 134 similar to the support surface 34 described above; however, the support surface 134 is situated generally perpendicular to the support surface 34. The support surface 134 includes a substantially planar section that contacts at least one side of the polygonal (trapezoidal) configuration of the element coil 12.

The support surface 134 of second holder 16 also includes rounded edges similar to the rounded edges 38 and 42 found on the support surface 34 of the first holder 14.

Figure 2:
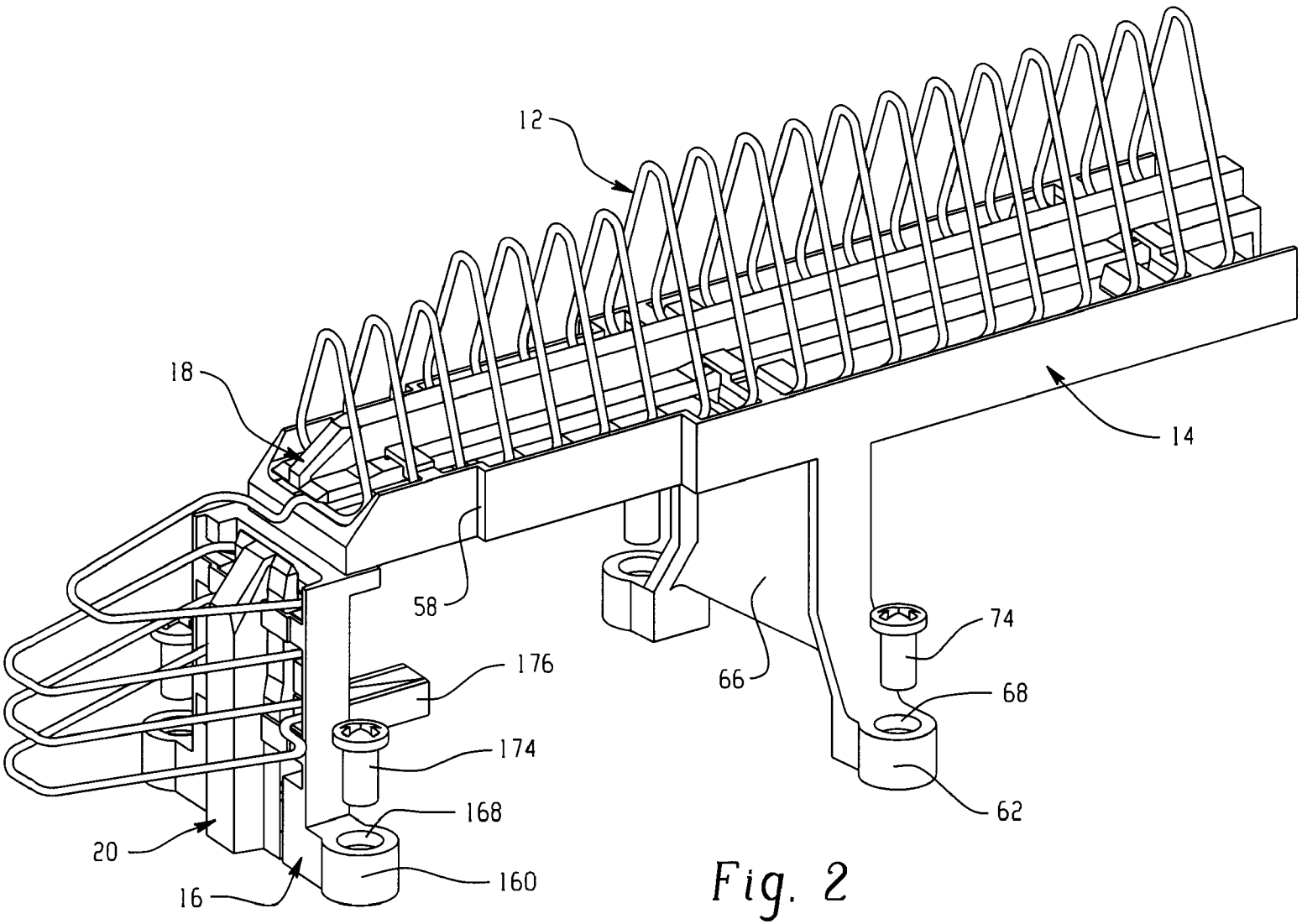
FIG. 2 is a perspective view of the vehicle antenna assembly of FIG. 1 in an assembled state.

The second holder 16 also includes supports 160 each having a fastener opening 168 formed through the support 160 for receiving a fastener 174 (FIG. 2). In addition to the supports 160, the second holder 16 also includes a base support extension 176. More particular to the illustrated embodiment, the base support extension 176 is formed on one side of a plane defined by the horizontal coil axis 30*b* and the vertical coil axis 30*v*. The base supports 160 and the base support extension 176 provide a stable foundation for supporting the second holder 16 as well as the first holder 14 when the first holder 14 is connected to the second holder 16.

Similar to the first holder 14, the second holder 16 also includes rails 180. The configuration of the rails 180 are very similar to the rails 80 described above in that each rail includes a resilient cantilevered section that extends over a portion of a gap defined between a pair of rails. A cross section taken normal to the vertical coil axis 30*v* and through the second holder 16 would be generally the same as that shown in FIGS. 3-5, except for cross-sectional configuration of the coil element 12 would be trapezoidal as opposed to triangular. Since the shape, function, and orientation of the rails 180 are the same as the rails 80 described above, further description of the rails 180 for the second holder 116 is not provided.

The second holder 16 also includes protrusions 200 that extend from the support surface 134. Each protrusion 200 is similar to the protrusions 100 described above. Accordingly, a respective protrusion 200 on the second holder 16 is spaced from a respective rail 180 a distance, which is measured parallel to the coil axis 30*v*, about equal to a diameter of the wire of the element coil 12. The protrusions 200 and the rails 180 cooperate to maintain proper pitch for the element coil 12. The protrusions 200 are also grouped in pairs where a first protrusion is spaced from a second protrusion a distance measured perpendicular to the plane P of symmetry a distance to accommodate the second retainer 20.

The second retainer 16 also includes a T-shaped connector element 202 formed in an opposite end (upper end) of the second holder 16 as compared to the base supports 160. The connector element 202 extends upwardly from a substantially planar pedestal surface 204. The distance between the pedestal surface 204 and the lower surface of the base 160 is about equal to the height of the support 60. The connector element 202 cooperates with channel members 206 formed in a lower surface of the pedestal 32 of the first holder 14 adjacent the first end 56 of the platform. Only one channel member 206 is visible in FIG. 1. The T-shaped connector element 202 slides into the channel members 206 to connect the second holder 16 to the first holder 14.

The second retainer 20 engages the rails 180 and applies a compressive load on the element coil 12 to fix the element coil with respect to the second holder 16. As with the first retainer 18 and the first holder 14, in the illustrated embodiment the second retainer 20 slides into engagement with the second holder 16, and thus may be referred to as a sliding retainer. The second retainer 20 is also made from a dielectric material. The second retainer is elongated in a direction parallel with the coil axis 30*v*. To engage the second holder 16, the second retainer slides in a direction generally parallel with the coil axis 30*v*.

The second retainer 20 is similar in configuration to the first retainer 18 in that the second retainer is generally T-shaped in a cross-section taken normal to the longest dimension of the second retainer. The second retainer 20 includes a base 210 and a column 212, which are similar to the base 110 and column 112 described above with regard to the first retainer 18. The second retainer 20 also includes a barb 230, similar to the barb 130, adjacent a first end 222 and an L-shaped flange 232 similar to the L-shaped flange 132 described above. The elongated column 212 of the second retainer 20 is also beveled near a second end 224. The second retainer 20 also includes ramps 220 that are similar to the ramps 120 found on the first retainer 18.

Figure 6:
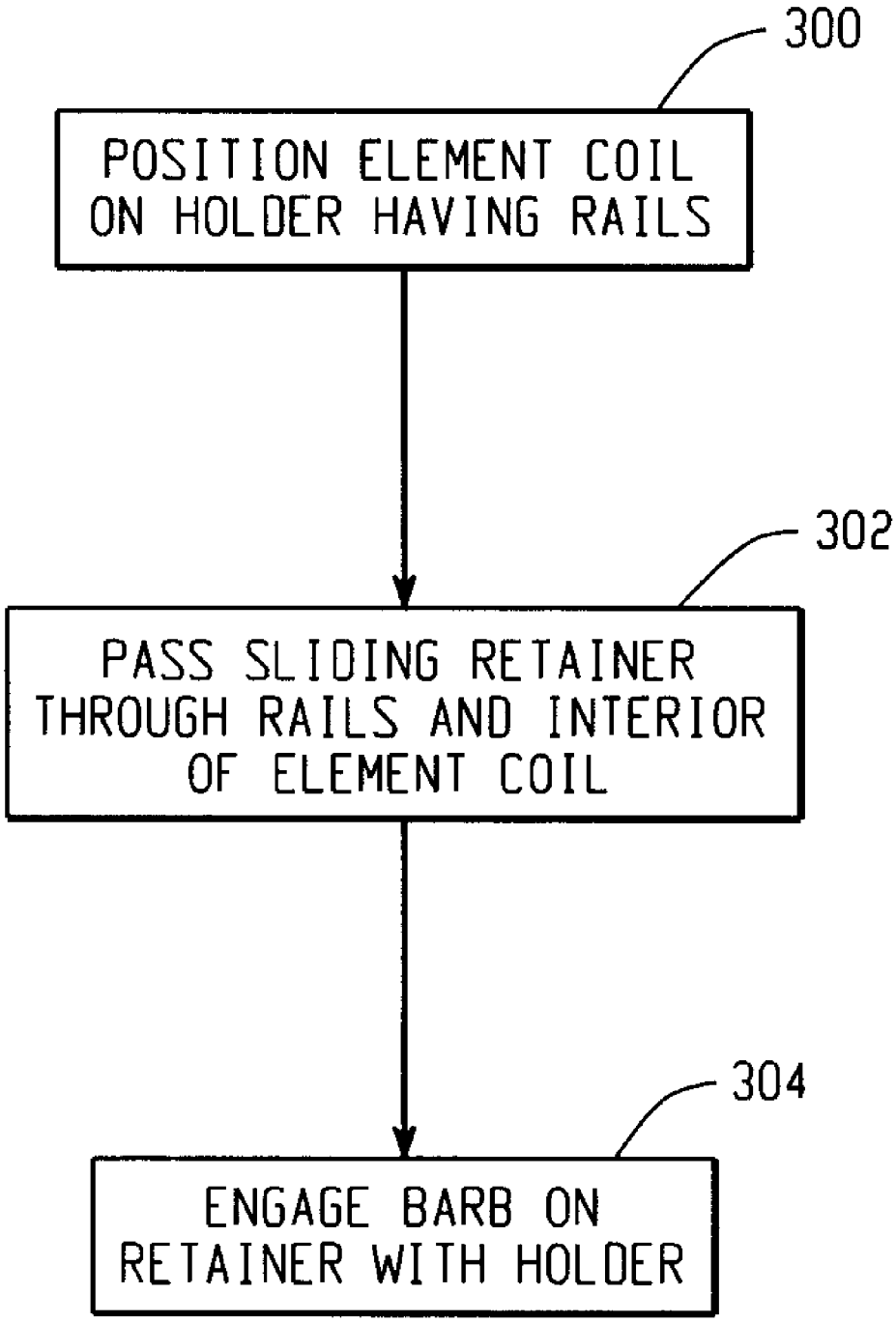
FIG. 6 is a flow chart depicting a method for holding an antenna element.

A method for holding the antenna element coil 12 is depicted in a flow chart shown in FIG. 6. As seen in FIG. 6, the method for holding the antenna element coil includes, at 300, positioning the element coil 12 on a holder, e.g. the first holder 14 or the second holder 16, having rails 80, 180, respectively. The method further includes, at 302, passing the sliding retainer, e.g. the first retainer 18 or the second retainer 20, through the rails 80,180 and the interior of the element coil 12. The method can further include, at 304, engaging the barbs 130 and 230 located adjacent the first ends 122 and 222 of the respective sliding retainers 18 and 20 with the respective holders 14 and 16. More particular to the illustrated embodiment, to assemble the vehicle antenna assembly, the element coil 12 is positioned on the first holder 14 having the rails 80. The first sliding retainer 18 is passed through the rails 80 and the interior of the element coil 12 to affix the element coil to the first holder 14. The element coil 12 is also positioned on the second holder 16 having rails 180. The second holder 16 can be attached to the first holder 14 prior to the aforementioned step and the second sliding retainer 20 can be passed through the rails 180 and the interior of the element coil 12 to fix the element coil to the second holder 16. Passing the sliding retainers 18 and 22 through the rails 80 and 180, respectively, can include bending the rails 80 and rails 180 to fix the element coil 12 to the respective holders. The method for holding the antenna element 12 can also include engaging the barbs 130 and 230 located adjacent the first ends 122 and 222 of the respective sliding retainers 18 and 20 with the respective holders 14 and 16.

A vehicle antenna assembly, an assembly for holding an antenna element, and a method for holding an antenna element have been described with reference to the particular embodiments. Modifications and alterations will occur to those upon reading and understanding the preceding detailed description. The invention, however, is not limited to only the embodiments illustrated above. Instead, the invention is broadly defined by the appended claims and the equivalents thereof.

The invention claimed is:

1. A vehicle antenna assembly comprising:

an element coil having a polygonal configuration in a cross section taken normal to a coil axis;

a holder including rails; and a retainer engaging the rails and applying a compressive force on the element coil to fix the element coil with respect to the holder.

2. The assembly of claim 1, wherein the holder includes a support surface having a substantially planar section that contacts at least one side of the polygonal configuration of the element coil, wherein the rails extend from the support surface.

3. The assembly of claim 2, wherein the holder includes protrusions extending from the support surface, a respective protrusion being spaced from a respective rail a distance about equal to a diameter of a wire of the element coil.

4. The assembly of claim 2, wherein the rails include a first rail spaced from a second rail in a direction perpendicular to the coil axis to define a gap, and the retainer being received in the gap.

5. The assembly of claim 4, wherein each rail includes a resilient cantilevered section extending over a portion of the gap, each cantilevered section contacting the retainer and applying a force against the retainer for holding the retainer in the gap.

6. The assembly of claim 1, wherein the holder includes a first holder and a second holder, the first holder retaining the element coil having the coil axis aligned in a first orientation, the second holder retaining the element coil having the coil axis aligned in a second orientation, which is angled with respect to the first orientation.

7. The assembly of claim 6, wherein the first orientation is perpendicular to the second orientation.

8. The assembly of claim 1, wherein the retainer slides into engagement with the holder.

9. The assembly of claim 8, wherein the retainer slides in a direction parallel with the coil axis.

10. The assembly of claim 8, wherein the retainer has a longest dimension parallel with the coil axis.

11. The assembly of claim 10, wherein the retainer is T-shaped in a cross section taken normal to the coil axis.

12. The assembly of claim 8, wherein the retainer includes a barb adjacent one end for engaging the holder.

13. The assembly of claim 1, wherein the holder includes a first holder and a second holder and the retainer includes a first retainer and a second retainer, wherein the first retainer slides into engagement with the first holder and the second retainer slides into engagement with the second holder.

14. An assembly for holding an antenna element comprising:

a holder including a support surface and at least two rails extending from the support surface, the at least two rails including a first rail spaced from a second rail to define a gap, the rails include a resilient section;

a sliding retainer received between the first rail and the second rail for retaining an associated antenna element against the holder.

15. The assembly of claim 14, wherein the resilient section is configured to apply a compressive force against the associated antenna element trapping a portion of the associated antenna element between the resilient section and the support surface.

16. The assembly of claim 14, wherein the sliding retainer includes a base having a first surface facing toward the support surface of the holder and a stepped second surface facing away from the support surface.

17. A method for holding an antenna element coil comprising:

positioning an element coil on a holder having rails; and passing a sliding retainer through the rails and an interior of the element coil to apply a compressive load on the element coil to fix the element coil to the holder.

18. The method of claim 17, wherein passing the sliding retainer includes bending the rails resulting in the compressive load being applied to the element coil against the holder.

19. The method of claim 17, further comprising engaging a barb located adjacent an end of the sliding retainer with the holder.

20. A method for holding an antenna element coil comprising:

positioning an element coil on a holder having rails;

passing a sliding retainer through the rails and an interior of the element coil to fix the element coil to the holder; and engaging a barb located adjacent an end of the sliding retainer with the holder.

21. An assembly for holding an antenna element comprising:

a holder including a support surface and at least two rails extending from the support surface, the at least two rails including a first rail spaced from a second rail to define a gap;

a sliding retainer received between the first rail and the second rail for retaining an associated antenna element against the holder, wherein the sliding retainer includes a base having a first surface facing toward the support surface of the holder and a stepped second surface facing away from the support surface.

22. An assembly for holding an antenna element comprising:

a holder including a support surface and at least two rails extending from the support surface, the at least two rails including a first rail spaced from a second rail to define a gap;

a sliding retainer received between the first rail and the second rail for retaining an associated antenna element against the holder, wherein the retainer includes a barb adjacent an end for engaging the holder.

* * * * *